US008493167B2

(12) United States Patent
Kim et al.

(10) Patent No.: US 8,493,167 B2
(45) Date of Patent: Jul. 23, 2013

(54) TRANSFORMER HAVING THE HEAT RADIATION FUNCTION

(75) Inventors: Jong Man Kim, Gyunggi-do (KR); Kyu Bum Han, Gyunggi-do (KR); Seog Moon Choi, Seoul (KR)

(73) Assignee: Samsung Electro-Mechanics Co., Ltd., Gyunggi-do (KR)

( * ) Notice: Subject to any disclaimer, the term of this patent is extended or adjusted under 35 U.S.C. 154(b) by 0 days.

(21) Appl. No.: 12/981,066

(22) Filed: Dec. 29, 2010

(65) Prior Publication Data

US 2012/0105186 A1 May 3, 2012

(30) Foreign Application Priority Data

Nov. 3, 2010 (KR) ..... 10-2010-0108827

(51) Int. Cl.
*H01F 27/08* (2006.01)

(52) U.S. Cl.
USPC ..... 336/61

(58) Field of Classification Search
USPC ..... 336/55–62, 198, 221
See application file for complete search history.

(56) References Cited

U.S. PATENT DOCUMENTS

| | | | | |
|---|---|---|---|---|
| 6,492,890 | B1 * | 12/2002 | Woznlczka | 336/61 |
| 6,600,402 | B1 * | 7/2003 | LaFleur et al. | 336/61 |
| 2008/0180205 | A1 * | 7/2008 | Tsai et al. | 336/192 |

FOREIGN PATENT DOCUMENTS

| | | | |
|---|---|---|---|
| JP | 06-215959 | | 8/1994 |
| JP | 2000100633 A | * | 4/2000 |
| KR | 10-0782910 | | 11/2007 |

* cited by examiner

*Primary Examiner* — Tuyen Nguyen
(74) *Attorney, Agent, or Firm* — Ladas & Parry LLP

(57) ABSTRACT

Disclosed herein is a transformer having a heat radiation function. The transformer includes a pair of cores having an E-shape and facing and contacting each other to form central pillars and outer peripheral parts, a transforming coil part wound on the central pillars of the pair of cores and dropping voltage, and a heat radiation pipe formed to have a cylindrical shape and positioned inward from the transforming coil part to radiate heat generated from the transforming coil part, thereby well discharging heat generated from the coil.

10 Claims, 12 Drawing Sheets

TRANSFORMER HAVING THE HEAT RADIATION FUNCTION

CROSS REFERENCE TO RELATED APPLICATION

This application claims the benefit of Korean Patent Application No. 10-2010-0108827, filed on Nov. 3, 2010, entitled "Transformer Having The Heat Radiation Function", which is hereby incorporated by reference in its entirety into this application.

BACKGROUND OF THE INVENTION

1. Technical Field

The present invention relates to a transformer having a heat radiation function.

2. Description of the Related Art

Generally, a transformer is a device supplied with AC power from one circuit to transfer the power to another circuit by an electromagnetic induction action.

In the transformer, voltage is in proportion to a winding ratio wound on a primary coil and a secondary coil and current is in inverse proportion to the winding ratio (V1:V2=N1:N2=1/I1:1/I2).

In the case of an ideal transformer, 100% of energy conversion efficiency in which input power is equal to output power may be performed; however, various kinds of loss are actually generated in a transformer, which leads to degradation in conversion efficiency.

The loss is generated depending on a thickness and a material of a core, which is generally Hysteresis loss and Eddy current loss.

Describing it in more detail, the Hysteresis loss is a loss generated when the magnetic field generated by the magnetization characteristics of the core is transformed into the magnetic field having different directions, which is changed according to the material of the core, is proportional to the use frequency, and is proportional to 1.6 square of a magnetic line of force Further, Eeddy current loss induces the induction voltage to the core of the transformer when the alternating magnetic flux flows in the core of the transformer. Therefore, the eddy current circling around the magnetic flux in a vertical direction to the alternating magnetic flux flows (Fleming's right hand rule), such that a Joule heat loss is generated in proportion to the square of Eddy current magnitude and the electric resistance of the core Heat is generated due to the loss generated in the transformer and as a result, the transformer becomes broken due to the heat generated accordingly.

SUMMARY OF THE INVENTION

The present invention has bee made in an effort to provide a transformer having a radiation function capable of discharging generated heat by installing a heat radiation pipe adjacent to coils.

According to a preferred embodiment of the present invention, there is provided a transformer having a heat radiation function, including: a pair of cores having an E-shape and facing and contacting each other to form central pillars and outer peripheral parts; a transforming coil part wound on the central pillars of the pair of cores and dropping voltage; and a heat radiation pipe formed to have a cylindrical shape and positioned inward from the transforming coil part to radiate heat generated from the transforming coil part.

The transformer having a heat radiation function may further include a heat induction pipe inserted into the transforming coil part and inducing heat to the heat radiation pipe.

The transformer having a heat radiation function may further include a thermal interface material layer coated on the heat radiation pipe and transferring heat generated from the transforming coil part to the heat radiation pipe.

The heat radiation pipe may penetrate through the central pillars of the pair of cores.

The heat radiation pipe may be positioned between the central pillar of the core and the coil part.

The transforming coil part may include a first coil part wound on the central pillar of the pair of cores and dropping voltage; and a second coil part wound on the first coil part and dropping voltage.

The transformer having a heat radiation function may further include a second heat radiation pipe formed to have a cylindrical shape and positioned between the first coil part and the second coil part to discharge heat generated from the first coil part and the second coil part to the outside.

The transformer having a heat radiation function may further include a second thermal interface material layer coated on the second heat radiation pipe and transferring heat generated from the transforming coil part to the second heat radiation pipe.

The first coil part may include a first coil wound on the central pillars of the pair of cores and dropping voltage and a first insulating film surrounding the first coil and made of insulating material, and the second coil part may include a second coil wound on the first coil part and dropping voltage and a second insulating film surrounding the second coil and made of an insulating material.

The transformer having a heat radiation function may further include an inner bobbin positioned between the central pillars of the pair of cores and the first coil, formed to have a cylindrical shape, and made of an insulating material; and an outer bobbin positioned between the first insulating film and the second core, formed to have a cylindrical shape, and made of an insulating material.

The terms and words used in the present specification and claims should not be interpreted as being limited to typical meanings or dictionary definitions, but should be interpreted as having meanings and concepts relevant to the technical scope of the present invention based on the rule according to which an inventor can appropriately define the concept of the term to describe most appropriately the best method he or she knows for carrying out the invention.

DESCRIPTION OF THE PREFERRED EMBODIMENTS

Figure 1:
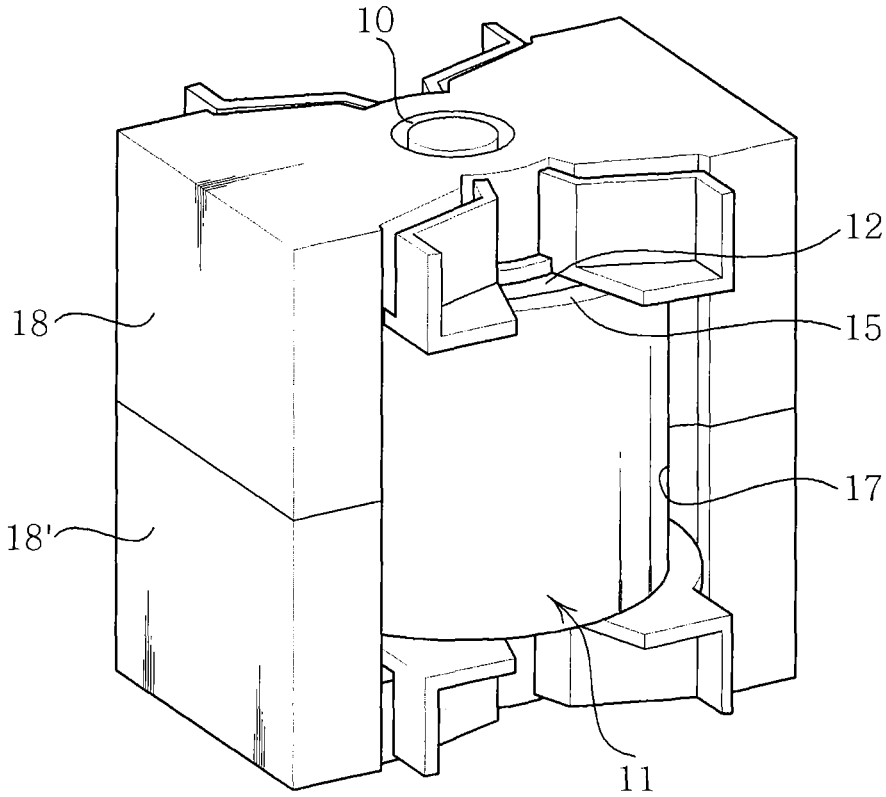
FIG. 1 is a perspective view of a transformer having a heat radiation function according to a first preferred embodiment of the present invention.

Various objects, advantages and features of the invention will become apparent from the following description of embodiments with reference to the accompanying drawings.

The terms and words used in the present specification and claims should not be interpreted as being limited to typical meanings or dictionary definitions, but should be interpreted as having meanings and concepts relevant to the technical scope of the present invention based on the rule according to which an inventor can appropriately define the concept of the term to describe most appropriately the best method he or she knows for carrying out the invention.

The above and other objects, features and advantages of the present invention will be more clearly understood from the following detailed description taken in conjunction with the accompanying drawings. In the specification, in adding reference numerals to components throughout the drawings, it is to be noted that like reference numerals designate like components even though components are shown in different drawings. Further, when it is determined that the detailed description of the known art related to the present invention may obscure the gist of the present invention, the detailed description thereof will be omitted.

Hereinafter, preferred embodiments of the present invention will be described in detail with reference to the accompanying drawings.

Figure 2:
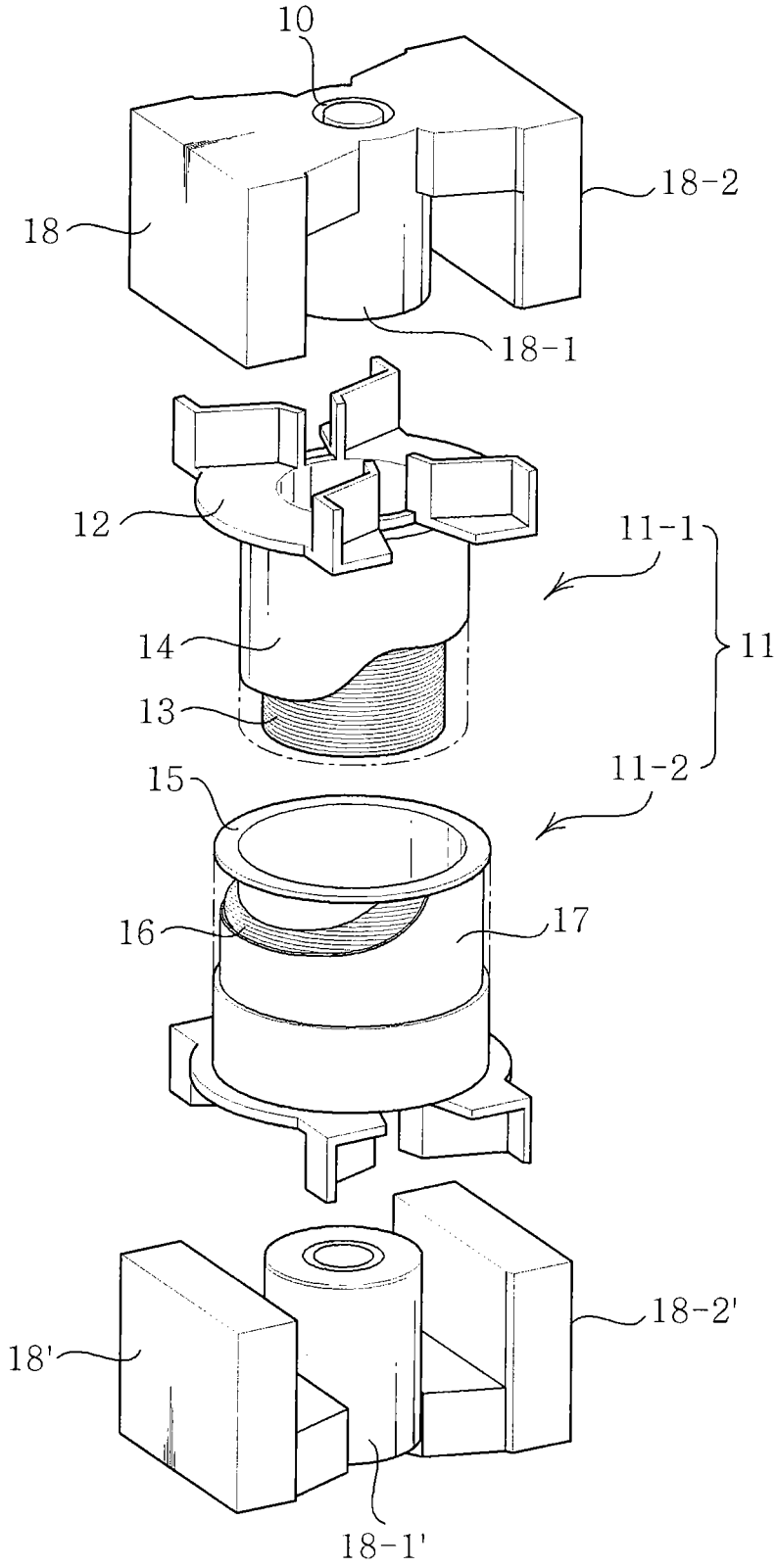
FIG. 2 is a separate perspective view of the transformer having a heat radiation function according to a first preferred embodiment of the present invention.
Figure 3:
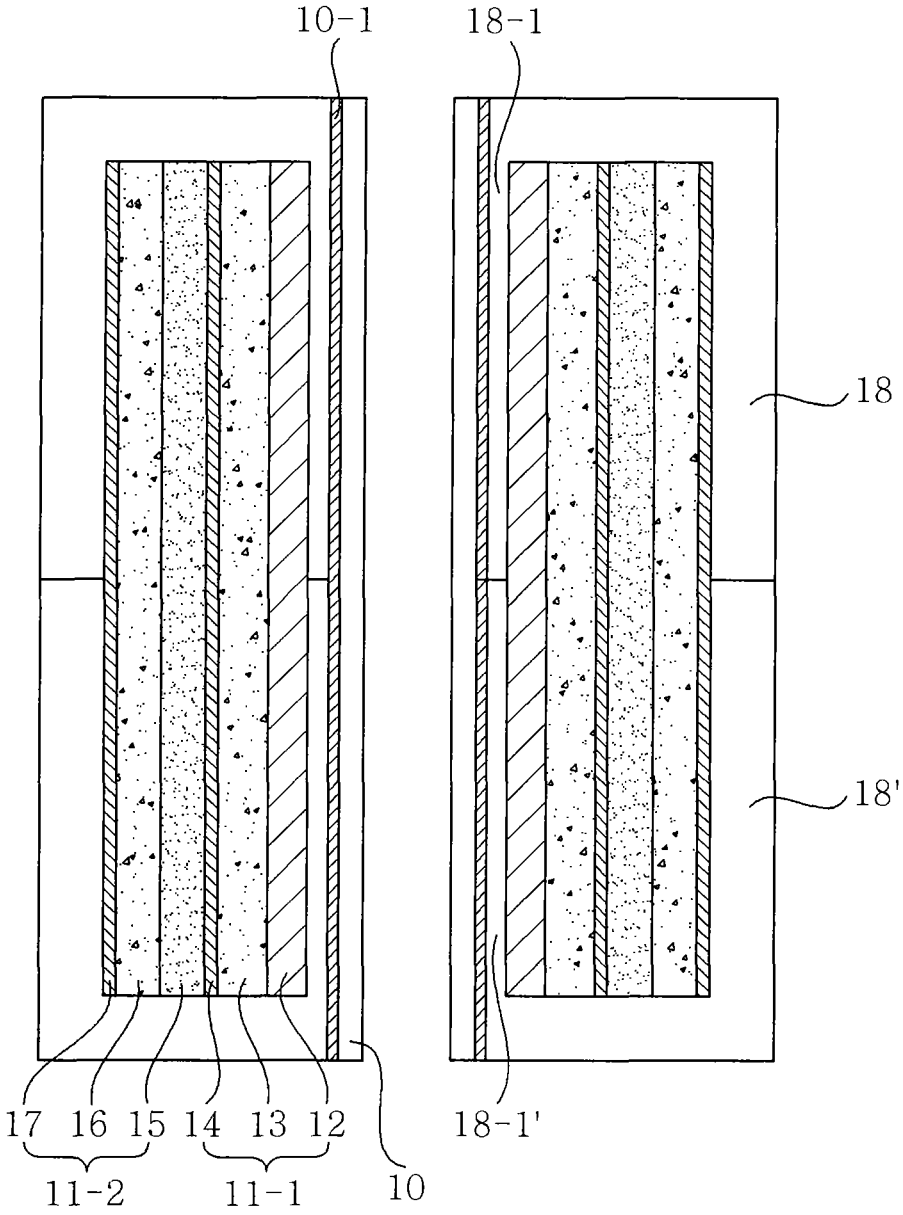
FIG. 3 is a cross-sectional view of the transformer having a heat radiation function according to a first preferred embodiment of the present invention.

FIG. 1 is a perspective view of a transformer having a heat radiation function according to a first preferred embodiment of the present invention, FIG. 2 is a separate perspective view of the transformer having a heat radiation function according to a first preferred embodiment of the present invention, and FIG. 3 is a cross-sectional view of the transformer having a heat radiation function according to a first preferred embodiment of the present invention.

Referring to FIGS. 1 to 3, the transformer having a heat radiation function according to a first preferred embodiment of the present invention includes a heat radiation pipe 10, a transforming coil part 11, and a pair of cores 18 and 18'.

The transforming coil part 11 includes a primary coil part 11-1 including an inner bobbin 12, a primary coil 13, and a primary insulating film 14, and a secondary coil part 11-2 including an outer bobbin 15, a secondary coil 16, and a secondary insulating film 17.

In this configuration, the heat radiation pipe 10 is formed to have a hollow cylindrical shape and penetrate through central pillars 18-1 and 18-1' of the pair of cores 18 and 18', thereby discharging heat generated from the primary coil 13 and the secondary coil 16 to the outside.

Although the heat radiation pipe 10 is formed to have a cylindrical shape, it may also be formed to have various shapes such as a quadrangular shape, a pentagonal shape, or the like. The heat radiation pipe 10 may preferably be made of a metal material in order to well discharge heat generated from the primary coil 13 and the secondary coil 16.

As shown in FIG. 3, the radiation heat pipe 10 is coated with a thermal interface material (TIM) layer 10-1 in order that the heat generated from the primary coil 13 and the secondary coil 16 may be transferred well.

The thermal interface material layer 10-1 may preferably be silicon, epoxy, or the like.

Next, the inner bobbin 12 is formed to have a cylindrical shape and is made of an insulating material to provide electrical insulation.

The primary coil 13 is wound on the outer peripheral surface of the inner bobbin 12 and is interacted with the secondary coil 16 to change voltage to be input.

The primary insulating film 14 is wound on the outside of the primary coil 13 wound on the inner bobbin 12 to electrically insulate the primary coil 13 from the secondary coil 16.

Next, the outer bobbin 15 is formed to have a cylindrical shape and is made of an insulating material to provide electrical insulation.

The secondary coil 16 is wound on the outer peripheral surface of the outer bobbin 15 and is interacted with the primary coil 13 to change voltage to be input.

The secondary insulating film 17 is wound on the outside of the secondary coil 16 wound on the outer bobbin 15 to electrically insulate the primary coil 13 from the secondary coil 16.

Meanwhile, the pair of cores 18 and 18' are formed to have an E shape and is vertically inserted into the inner bobbin 12, thereby forming central pillars 18-1 and 18-1' formed inward from the inner bobbin 12 and in the center thereof and outer peripheral parts 18-2 and 18-2' formed outward from the outer bobbin 15 and in the outside thereof.

In this configuration, the primary insulating film 14 primarily insulates the primary coil 13 from the secondary coil 16 and the outer bobbin 15 wound with the secondary coil 16 secondarily insulates the primary coil 13 from the secondary coil 16, wherein the outside of the secondary coil 16 is double-insulated by the secondary insulating film 17.

According to the present invention, heat generated from the primary coil 13 and the secondary coil 16 is transferred to the heat radiation pipe 10 through the thermal interface material layer 10-1 and the heat transferred to the heat radiation pipe 10 is discharged to the outside, thereby making it possible to lower a temperature of the transformer.

As described above, the heat generated from the primary and second coils 13 and 16 is effectively discharged, thereby making it possible to lower the temperature of the core to a predetermined temperature. As a result, desired characteristics can be obtained, thereby making it possible to improve product reliability of the transformer.

Figure 4:
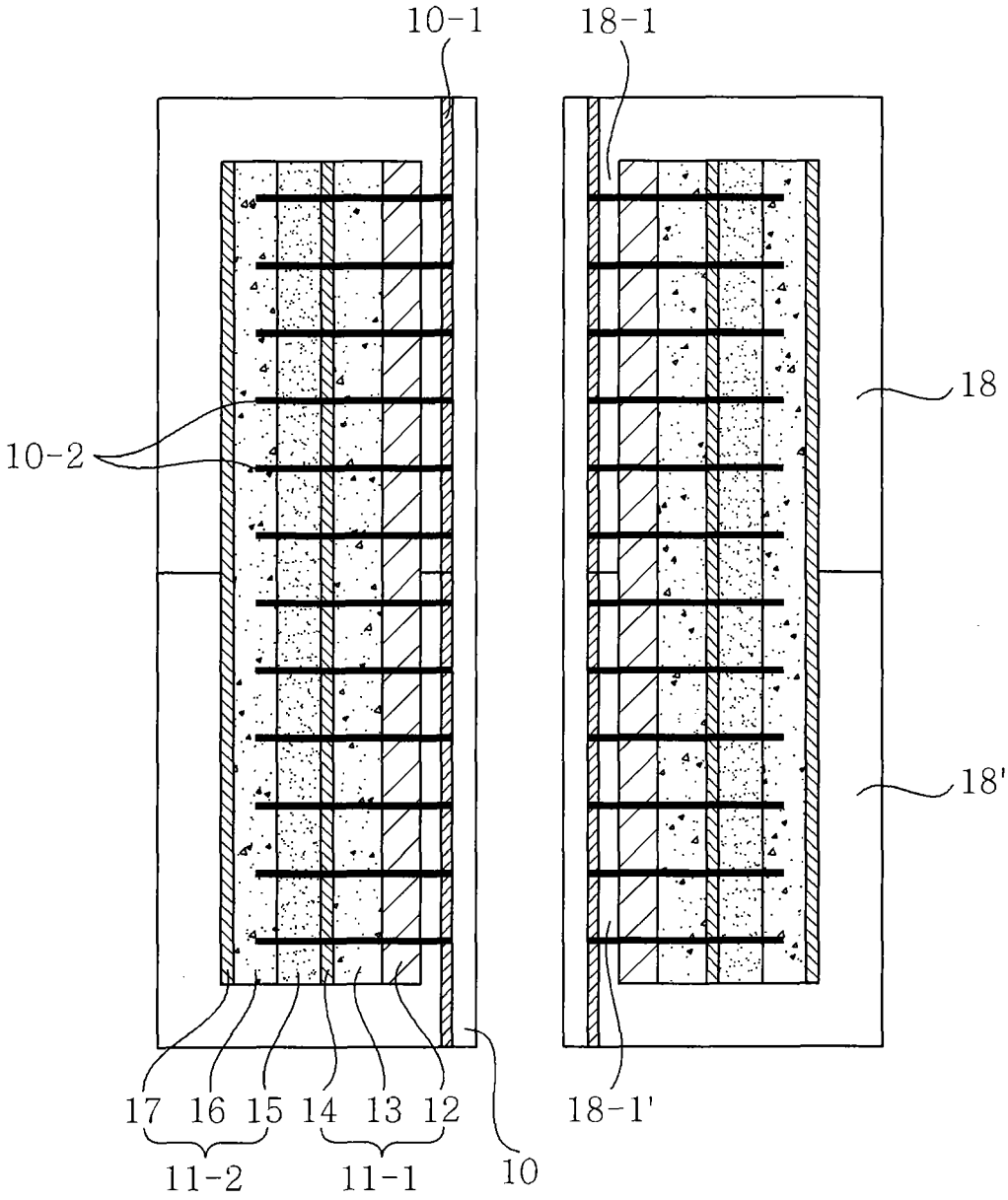
FIG. 4 is a cross-sectional view of a transformer having a heat radiation function according to a second preferred embodiment of the present invention.

FIG. 4 is a cross-sectional view of a transformer having a heat radiation function according to a second preferred embodiment of the present invention.

As shown in FIG. 4, the transformer having a heat radiation function according to a second preferred embodiment of the present invention includes a plurality of heat induction pipes 10-2 branched from the heat radiation pipe and inserted into the primary coil 13 and the secondary coil 16 in order to easily transfer the heat generated from the primary coil 13 and the secondary coil 16 to the heat radiation pipe 10.

The heat induction pipe 10-2 is made of the same metal material as that of the heat radiation pipe 10 to induce the heat generated from the primary coil 12 and the secondary coil 16, thereby being easily discharged.

Other constituents are the same as those in the first embodiment of the present invention and thus, a detailed description thereof will be omitted.

Figure 5:
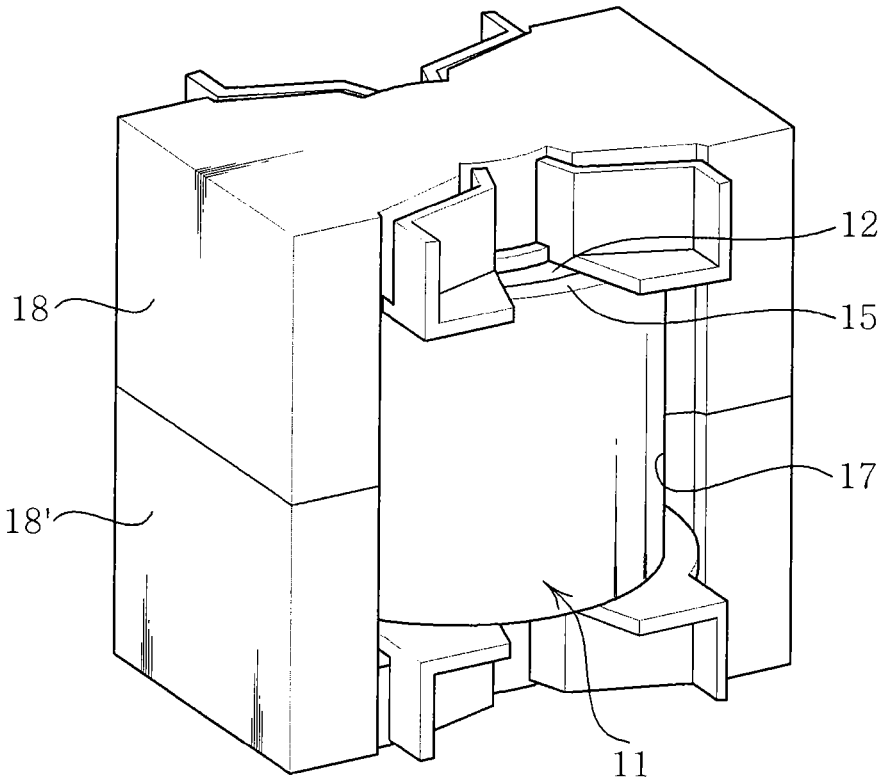
FIG. 5 is a perspective view of a transformer having a heat radiation function according to a third preferred embodiment of the present invention.
Figure 6:
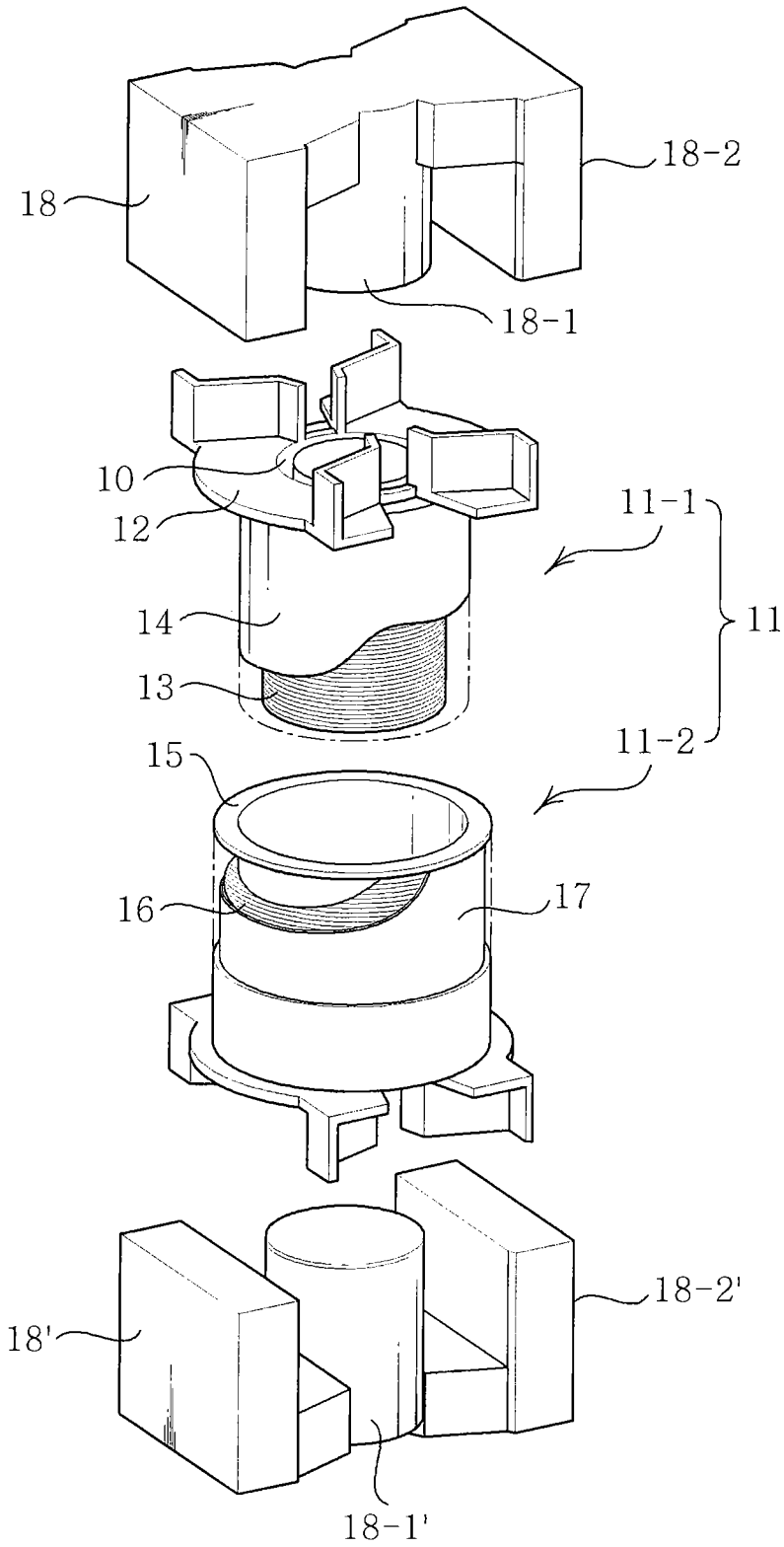
FIG. 6 is a separate perspective view of the transformer having a heat radiation function according to a third preferred embodiment of the present invention.

FIG. 5 is a perspective view of a transformer having a heat radiation function according to a third preferred embodiment of the present invention and FIG. 6 is a separate perspective view of the transformer having a heat radiation function according to a third preferred embodiment of the present invention.

Referring to FIGS. 5 and 6, the transformer having a heat radiation function according to the third preferred embodiment of the present invention and that of the first embodiment are different in that the heat radiation pipe 10 is positioned between the central pillars of the pair of cores 18 and 18' and the transforming coil part 11, and are the same in features other than the structure. In addition, the transformer having a heat radiation function according to a third preferred embodiment of the present invention may further include a heat induction pipe inducting heat generated from the transforming coil part 11, as shown in FIG. 4. The third embodiment is similar to the first embodiment in feature other than the structure and thus a detailed description thereof will be omitted.

Figure 7:
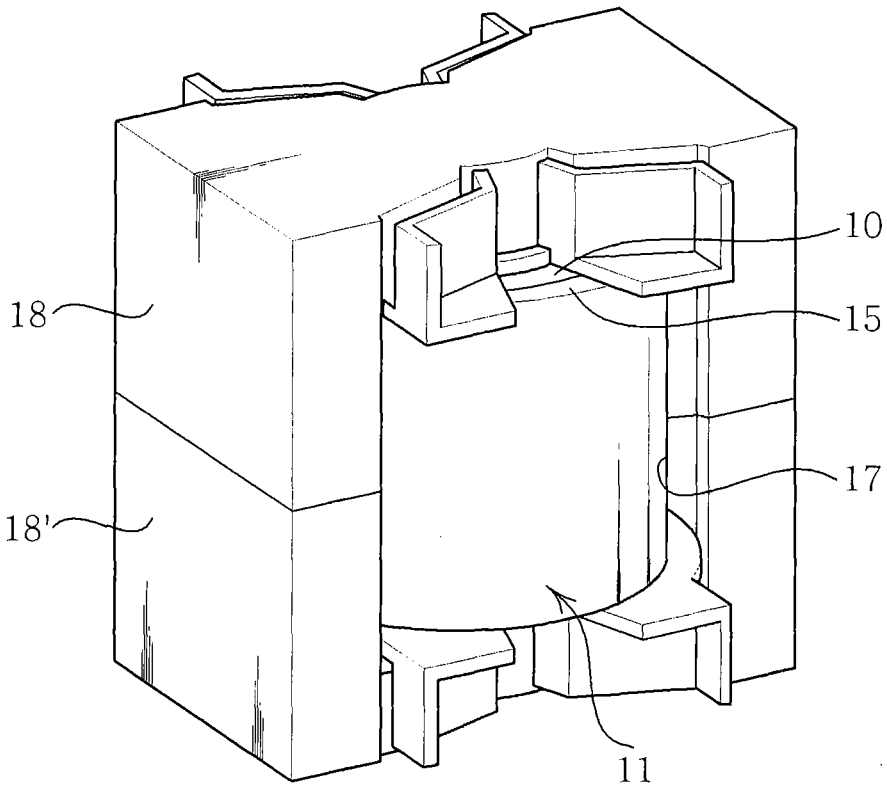
FIG. 7 is a perspective view of a transformer having a heat radiation function according to a fourth preferred embodiment of the present invention.
Figure 8:
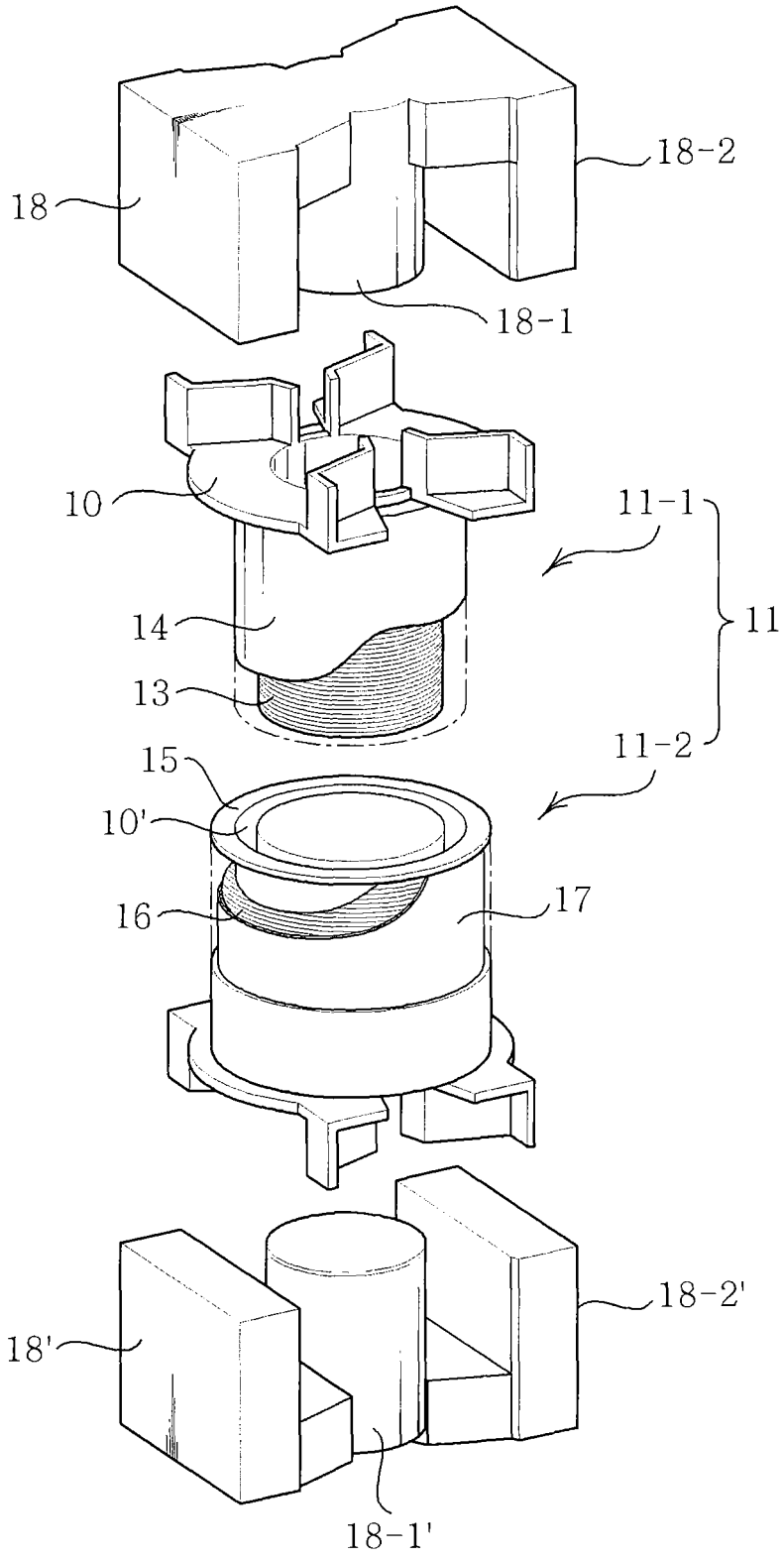
FIG. 8 is a separate perspective view of the transformer having a heat radiation function according to a fourth preferred embodiment of the present invention.

FIG. 7 is a perspective view of a transformer having a heat radiation function according to a fourth preferred embodiment of the present invention and FIG. 8 is a separate perspective view of the transformer having a heat radiation function according to a fourth preferred embodiment of the present invention.

Referring to FIGS. 7 and 8, the transformer having a heat radiation function according to a fourth preferred embodiment of the present invention and that of the third embodiment are different in that the heat radiation pipe 10 serves as the inner bobbin and are the same in features other than the structure. The fourth embodiment is similar to the third embodiment and thus a detailed description thereof will be omitted.

If the heat radiation pipe 10 serves as the inner bobbin as described above, a slim transformer may be implemented.

Figure 9:
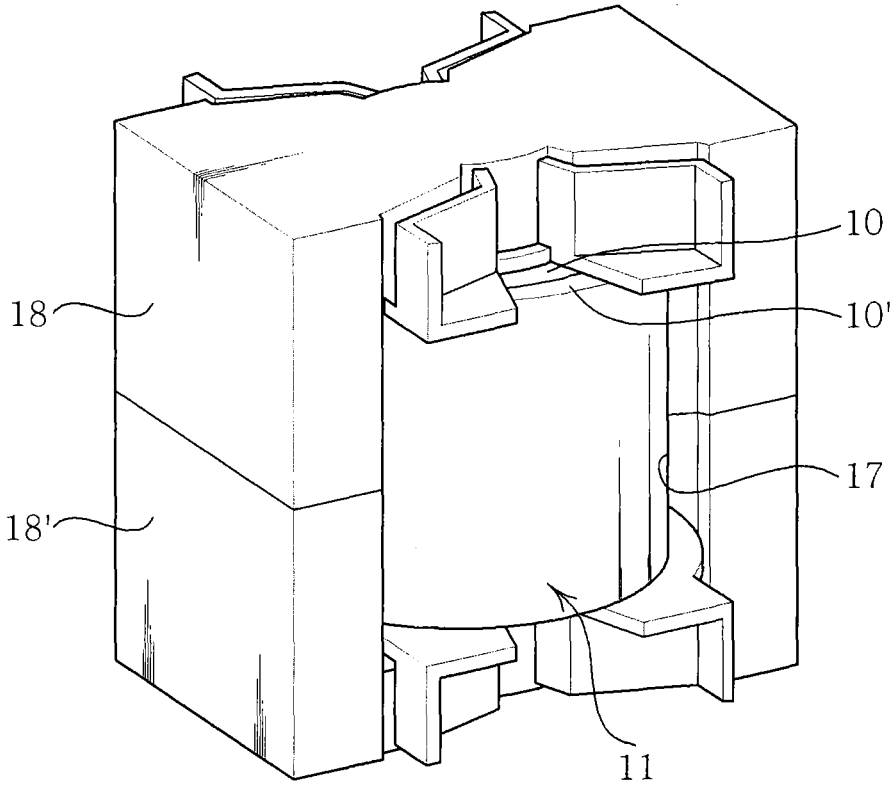
FIG. 9 is a perspective view of a transformer having a heat radiation function according to a fifth preferred embodiment of the present invention.
Figure 10:
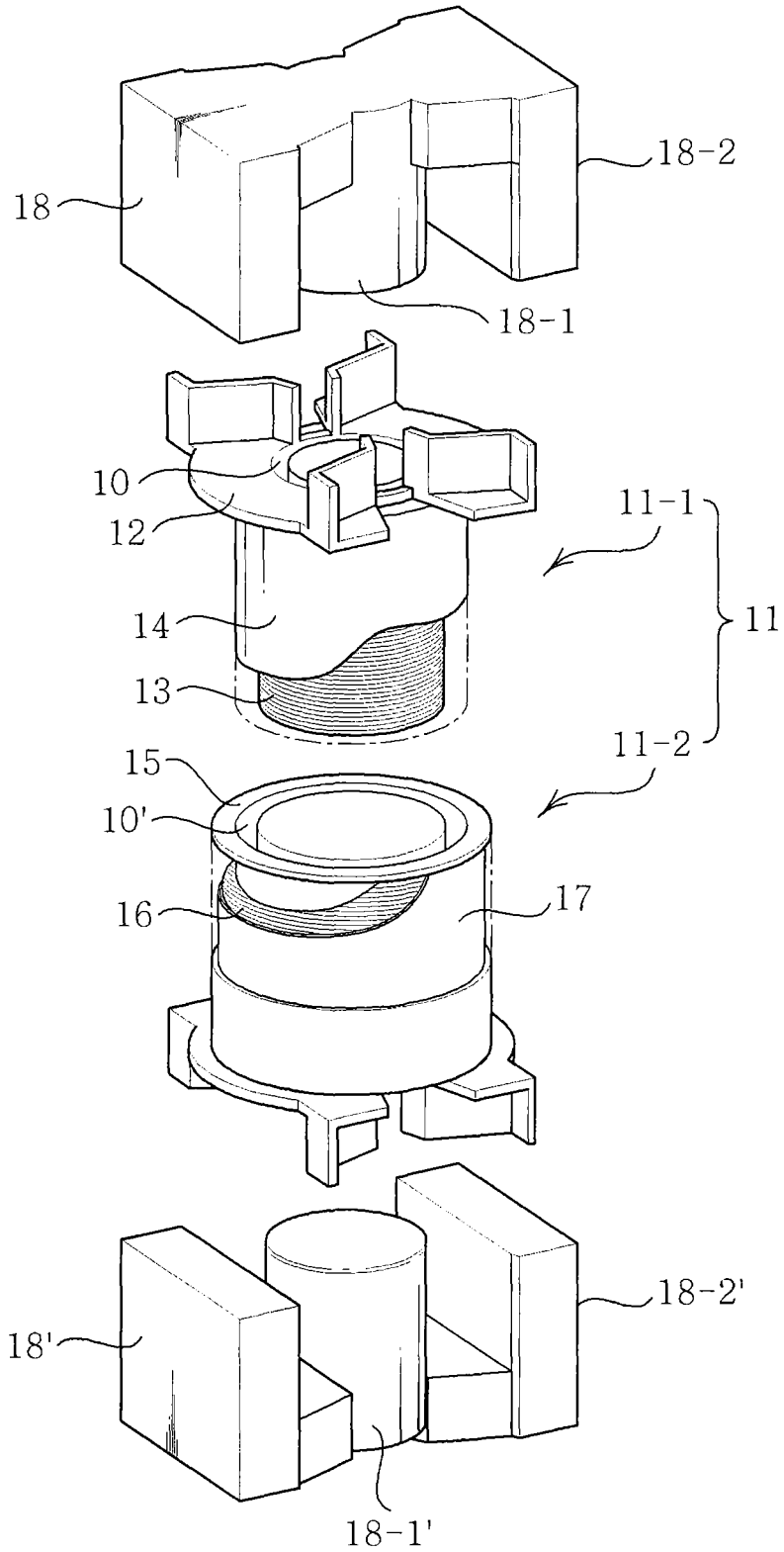
FIG. 10 is a separate perspective view of the transformer having a heat radiation function according to a fifth preferred embodiment of the present invention.

FIG. 9 is a perspective view of a transformer having a heat radiation function according to a fifth preferred embodiment of the present invention and FIG. 10 is a separate perspective view of the transformer having a heat radiation function according to a fifth preferred embodiment of the present invention.

Referring to FIGS. 9 and 10, the transformer having a heat radiation function according to a preferred fifth embodiment of the present invention and that of the third embodiment are different in that the transformer further includes a second heat radiation pipe 10' between a first coil part and a second coil part and a second thermal interface material layer (not shown) coated on the second heat radiation pipe 10' and transferring heat generated form the second coil part to the second heat radiation pipe, and are the same in features other than the structure.

If the second heat radiation pipe 10' is further included between the first coil part 11-1 and the second coil part 11-2, the heat generated from the first coil part 11-1 and the second coil part 11-2 can be better discharged.

Figure 11:
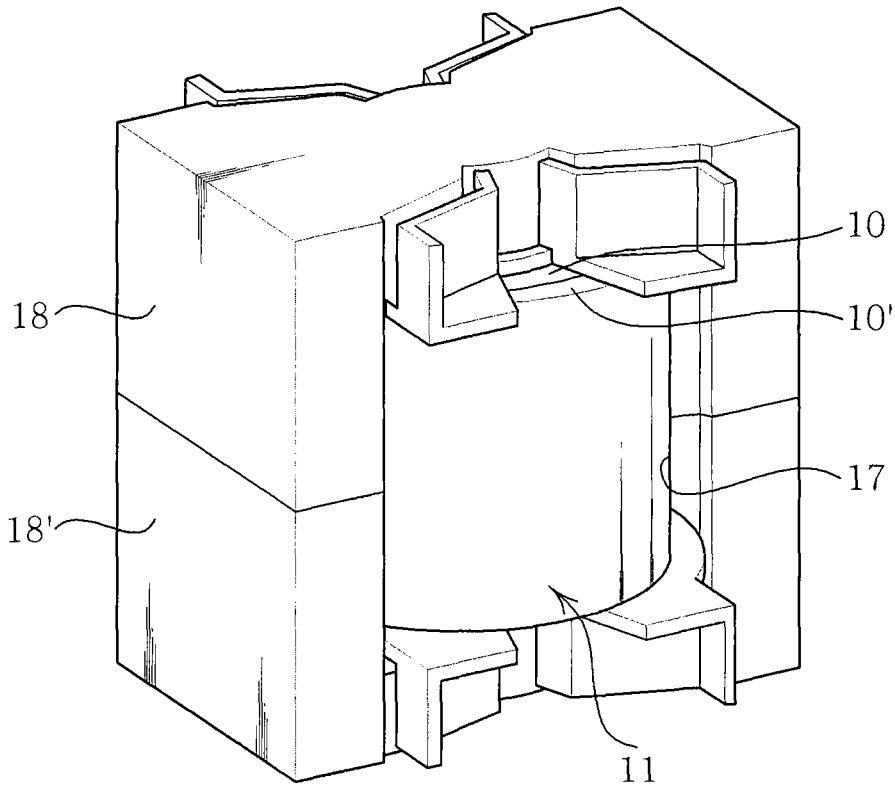
FIG. 11 is a perspective view of a transformer having a heat radiation function according to a sixth preferred embodiment of the present invention.
Figure 12:
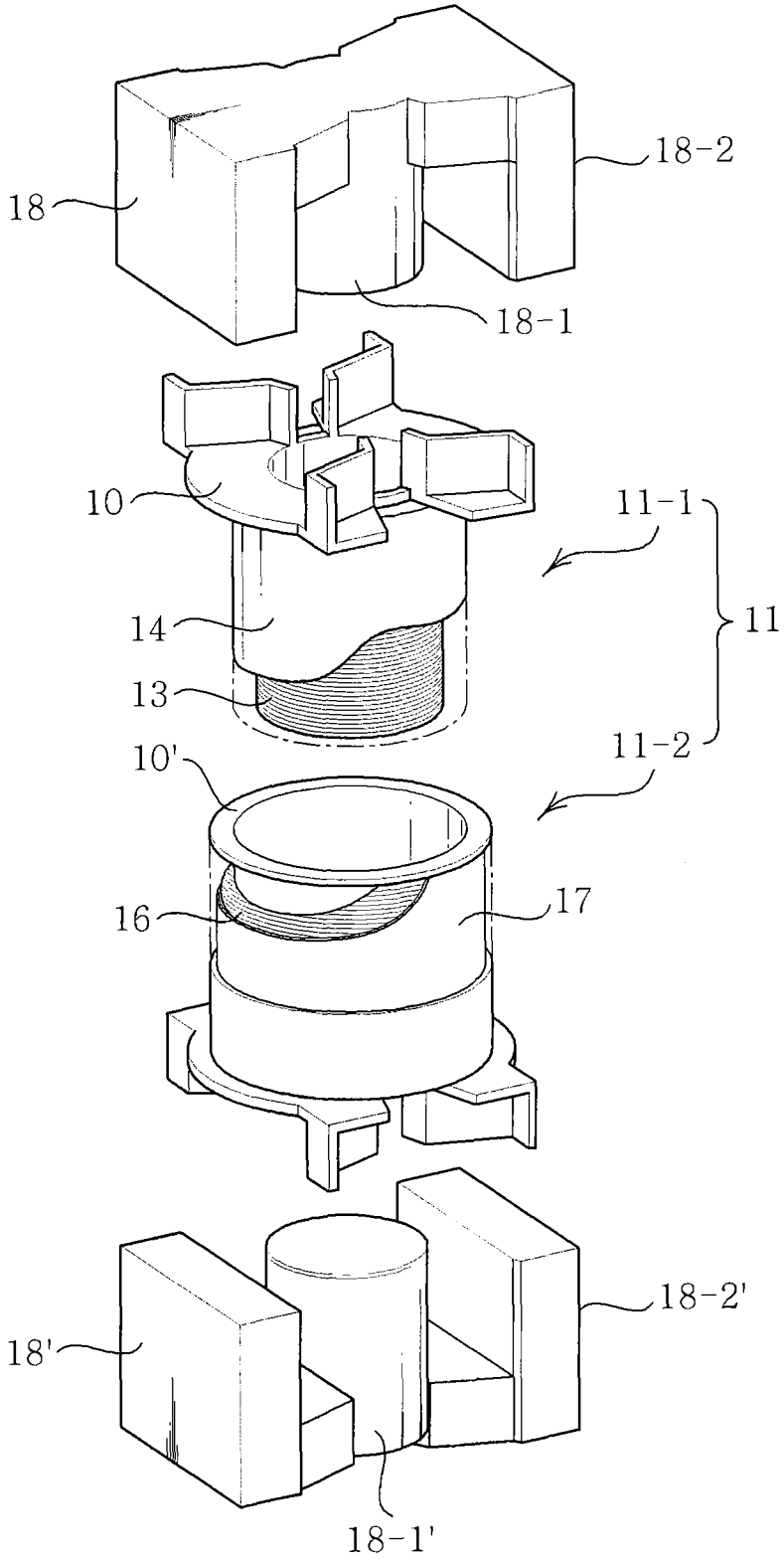
FIG. 12 is a separate perspective view of the transformer having a heat radiation function according to a sixth preferred embodiment of the present invention.

FIG. 11 is a perspective view of a transformer having a heat radiation function according to a sixth preferred embodiment of the present invention and FIG. 12 is a separate perspective view of the transformer having a heat radiation function according to a sixth preferred embodiment of the present invention.

Referring to FIGS. 11 and 12, the transformer having a heat radiation function according to a sixth preferred embodiment of the present invention and that of the fifth embodiment are different in that the heat radiation pipe 10 serves as the inner bobbin and the second heat radiation pipe 10' serves as the outer bobbin and are the same in features other than the structure. The sixth embodiment is similar to the fifth embodiment and thus a detailed description thereof will be omitted.

If the heat radiation pipe 10 serves as the inner bobbin and the second heat radiation pipe 10' serves as the outer bobbin as described above, a slim transformer may be implemented.

According to the present invention, it is possible to effectively discharge heat generated from the coil, thereby making it possible to lower the temperature of the core to a predetermined temperature.

The desired characteristics can be obtained accordingly, thereby making it possible to improve product reliability of the transformer.

Although the preferred embodiments of the present invention have been disclosed for illustrative purposes, those skilled in the art will appreciate that various modifications, additions and substitutions are possible, without departing from the scope and spirit of the invention as disclosed in the accompanying claims. Accordingly, such modifications, additions and substitutions should also be understood to fall within the scope of the present invention.

What is claimed is:

1. A transformer having a heat radiation function, comprising:

a pair of cores having an E-shape and facing and contacting each other to form central pillars and outer peripheral parts;

a transforming coil part wound on the central pillars of the pair of cores and dropping voltage; and a heat radiation pipe formed to have a cylindrical shape and positioned inward from the transforming coil part to radiate heat generated from the transforming coil part, wherein the heat radiation pipe is located in the central pillars of the cores.

2. The transformer having a heat radiation function as set forth in claim 1, further comprising a heat induction pipe inserted into the transforming coil part and inducing heat to the heat radiation pipe.

3. The transformer having a heat radiation function as set forth in claim 1, further comprising a thermal interface material layer coated on the heat radiation pipe and transferring heat generated from the transforming coil part to the heat radiation pipe.

4. The transformer having a heat radiation function as set forth in claim 1, wherein the heat radiation pipe penetrates through the central pillars of the pair of cores.

5. The transformer having a heat radiation function as set forth in claim 1, wherein the heat radiation pipe is positioned between the central pillar of the core and the coil part.

6. The transformer having a heat radiation function as set forth in claim 1, wherein the transforming coil part includes:

a first coil part wound on the central pillar of the pair of cores and dropping voltage; and a second coil part wound on the first coil part and dropping voltage.

7. The transformer having a heat radiation function as set forth in claim 6, further comprising a second heat radiation pipe formed to have a cylindrical shape and positioned between the first coil part and the second coil part to discharge heat generated from the first coil part and the second coil part to the outside.

8. The transformer having a heat radiation function as set forth in claim 7, further comprising a second thermal interface material layer coated on the second heat radiation pipe and transferring heat generated from the transforming coil part to the second heat radiation pipe.

9. The transformer having a heat radiation function as set forth in claim 6, wherein the first coil part includes a first coil wound on the central pillars of the pair of cores and dropping voltage; and a first insulating film surrounding the first coil and made of insulating material, the second coil part includes a second coil wound on the first coil part and dropping voltage; and a second insulating film surrounding the second coil and made of an insulating material.

10. The transformer having a heat radiation function as set forth in claim 9, further comprising:

an inner bobbin positioned between the central pillars of the pair of cores and the first coil, formed to have a cylindrical shape, and made of an insulating material; and an outer bobbin positioned between the first insulating film and the second core, formed to have a cylindrical shape, and made of an insulating material.

* * * * *